US006369516B1

(12) United States Patent
Iketsu et al.

(10) Patent No.: US 6,369,516 B1
(45) Date of Patent: Apr. 9, 2002

(54) DRIVING DEVICE AND DRIVING METHOD OF ORGANIC THIN FILM EL DISPLAY

(75) Inventors: Yuichi Iketsu; Yoshikazu Sakaguchi, both of Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/676,846

(22) Filed: Sep. 29, 2000

(30) Foreign Application Priority Data

Oct. 5, 1999 (JP) ..... 11-284167

(51) Int. Cl.[7] ..... G09G 3/10

(52) U.S. Cl. ..... 315/169.3; 315/169.1; 345/76; 345/214

(58) Field of Search ..... 315/169.1, 169.3; 345/204, 205, 213, 214, 73, 76, 55

(56) References Cited

U.S. PATENT DOCUMENTS 5,309,150 A * 5/1994 Ohba et al. ..... 345/208
5,844,368 A * 12/1998 Okuda et al. ..... 315/169.3
6,175,193 B1 * 1/2001 Kishita et al. ..... 315/169.3

FOREIGN PATENT DOCUMENTS

JP 9-232074 * 9/1997

* cited by examiner

*Primary Examiner*—Don Wong
*Assistant Examiner*—Thuy Vinh Tran
(74) *Attorney, Agent, or Firm*—Hayes Soloway

(57) ABSTRACT

A comparator compares the signal voltage S (i, j) applied to the display element P(i, j) on a predetermined data electrode Xi on the scanning electrode Yj for the current display period and the signal voltage S(i, j+1) applied to the display element P(i, j+1) on the data electrode Xi on the scanning electrode Y (j+1) during the next display period. A controller controls a discharge of residual electric charges or a quantity of residual electric charges discharged from the data electrode Xi during a blanking period immediately before the next display period depending on the comparison result by the comparator.

13 Claims, 8 Drawing Sheets

DRIVING DEVICE AND DRIVING METHOD OF ORGANIC THIN FILM EL DISPLAY

BACKGROUND OF THE INVENTION

1. Field of the Invention

The present invention relates to a deriving device and a driving method of an organic thin film electroluminescent (EL) display. In particular, the present invention relates to a driving device and a driving method of an organic thin film EL display with reduced power consumption.

2. Description of the Related Art

An example of conventional methods for driving an organic thin film EL display is described in Japanese Patent Laid-Open Publication No. Hei 9-232074. FIG. 1 is a circuit diagram of the prior art showing an example of a conventional configuration where data electrodes Xi and scanning electrodes Yj arrayed in a matrix are passively driven, A blanking period is provided between display periods. All the switching circuits 9*i*, 7*j* are switched to the ground side in response to a blanking pulse transmitted during this period. As a result, residual electric charges accumulated in all the data lines are discharged. In FIG. 1, reference numeral 2 is an image memory, reference numeral 8 is a driving circuit, reference numeral 4 is an organic thin film EL display, reference numeral 5 is a scanning circuit, reference numeral 51 is a sift register, and reference numeral 6*j* is an OR circuit.

A pixel P(i, j) is taken for example here. If a scanning electrode Yj to which this pixel P(i, j) belongs is selected, that is, the pixel P(i, j) is in a turned-off state during a display period Tj, a reverse bias is applied to the parallel capacitors of all the pixels P(i, 1) to P(i, j-1) and P(i, j+1) to P(i, n) belonging to a data electrode Xi except for the pixel P(i, j). If a shift is made to the next display period (T(J+1) in this state and pixel P(i, J+1) is turned on, current from a current source circuit 8*i* connected to the data electrode Xi is first used to cancel charge of the aforementioned reverse-biased parallel capacitors. Consequently, a long delay develops before the pixel P(i, j+1) actually starts emitting light, and thereby a large-capacitance display is not enabled. Thus, a certain effect can be made by providing a blanking period tj between the display period Tj and the display period T(j+1) and applying the data electrode Xi to the ground potential during this blanking period to cancel the charge of the reverse-biased parallel capacitor of the pixel P(i, 1) to P(i, J−1) and P(i, j+1) to P(i, n).

However, if the pixel P(i, j) is in a turned-on state during the display period Tj, all the pixels P(i, 1) to P(i, J=1) and P(i, j+1) to P(i, n) belonging to the data electrode Xi except for the pixel P(i, j) are almost zero-biased. Since the parallel capacitor of the pixel P(i, j) is forward-biased, applying the data electrode Xi to the ground potential during the blanking period tj is not only almost useless, but also electric charges in the forward-biased parallel capacitor of the pixel P(i, j) are wasted.

SUMMARY OF THE INVENTION

An object of the present invention is to provide a driving device and a driving method of an organic thin film EL display with power consumption reduced by a configuration where electric charge accumulated in a display element are used to assist a display element to emit light during the next display period.

A driving device of an organic thin film EL display according to a first aspect of the present invention, display elements composed of organic thin film EL light-emitting elements are connected to respective intersections of data electrodes and scanning electrodes arrayed in a matrix. While the scanning electrode is scanned at predetermined periods, the display element emits light in response to a signal applied to the data electrode in synchronization with the scanning. The driving apparatus has a comparator comparing a signal voltage applied to a display element on a predetermined data electrode and on a scanning electrode for the current display period and a signal voltage applied to the display element on the data electrode and on the scanning electrode for the next display period. The driving device also has a controller controlling a discharge of residual electric charges from the data electrode on the currently displaying scanning electrode during a blanking period immediately before the next display period depending on the comparison result by the comparator.

In a driving device of an organic thin film EL display according to the second aspect of the present invention, display elements composed of organic thin film EL light-emitting elements are connected to respective intersections of data electrodes and scanning electrodes arrayed in a matrix. While the scanning electrode is scanned at predetermined periods, the display element emits light in response to a signal applied to the data electrode in synchronization with the scanning. The driving device has a comparator comparing a signal voltage of the display element on a predetermined data electrode and on the scanning electrode for the current display period and a signal voltage of the display element on this data electrode and on the scanning electrode for the next display period. The driving device also has a controller controlling a quantity of residual electric charges discharged from the data electrode on the currently displaying scanning electrode during a blanking period immediately before the next display period depending on the comparison result by the comparator.

If an image signal voltage S(i, j) for the current display period is larger than an image signal voltage S(i, j+1) for the next display period, the controller controls the data electrode on the currently displaying scanning electrode so that residual electric charges are discharged during the blanking period immediately before the next display period. If an image signal voltage S(i, j) for the current display period is equal to or less than an image signal voltage S(i, j+1) for the next display period, the controller controls the data electrode so that the residual electric charges are not discharged.

Further, the controller also controls a discharge circuit which holds the data electrode at the ground level, for example.

Also provided is an image memory having a memory capacity at least enough for 2×m (m: the number of data electrodes). The signal voltage applied to each data electrode on the currently displaying scanning electrode for a display period and the signal voltage applied to the data electrode on the scanning electrode for the next display period are stored in this image memory so that the comparator can compare the data in the image memory.

The driving device of an organic film EL display also has the same number of discharge circuits as, for example, the number of data electrodes (m).

In the driving method of an organic thin film EL display according to the present invention, display elements composed of organic thin film EL light-emitting elements can connected to respective intersections of data electrodes and scanning electrodes arrayed in a matrix. While the scanning electrode is canned at predetermined periods, the display element emits light in response to a signal applied to the data electrode in synchronization with the scanning. The driving method has steps of comparing a signal voltage applied to the display element on a predetermined data electrode on the scanning electrode for the current display period and a signal voltage applied to the display element on this data electrode and on the scanning electrode for the next display period; and controlling the data electrode so as to be in the discharge state during the blanking period immediately before the display period when the signal voltage applied to the display element on the predetermined data electrode on the scanning electrode for the current display period is larger than the signal voltage applied to the display element on the data electrode for the next display period or controlling the data electrode so as not to be in the discharge state otherwise.

According to the driving device and the driving method of an organic thin film EL display of the present invention, residual electric charges which are conventionally discharged uniformly from all the data electrodes during the blanking period are discharged individually from each data electrode. That is, since residual electric charges do not need to be discharged from a data electrode during the blanking period if the signal voltage for the current display period is not larger than the signal voltage for the next display period, a wasted outflow of electric charges can be prevented by detecting such an electrode. Thus, the first effect of the present invention is electric power saving. It is particularly effective to a display pattern such that all of display elements (pixels) are turned on or the like, where signal voltage applied to each data electrode does not decrease.

According to the present invention, the second effect of the present invention is the improvement of responsiveness when a pixel emits light and the improvement of brightness since residual electric charges which are not discharged during the blanking period are contributed to the charge of the parallel capacitor of a pixel which should emit light during the next display period.

The nature, principle, and utility of the invention will become more apparent from the following detailed description when read in conjunction with the accompanying drawings in which like parts are designated by like reference numerals or characters.

DETAILED DESCRIPTION OF THE PREFERRED EMBODIMENT

Embodiments of the driving device and driving method of an organic thin film EL display according to the present invention will be described in detail below with reference to accompanying drawings.

The driving device of an organic thin film EL display according to the present invention is characterized in that, when data electrodes and scanning electrodes arrayed in a matrix are passing driven, residual electric charges which are uniformly discharged from all the data electrodes in a conventional manner during a blanking period are discharged individually from each data electrode.

Figure 1:
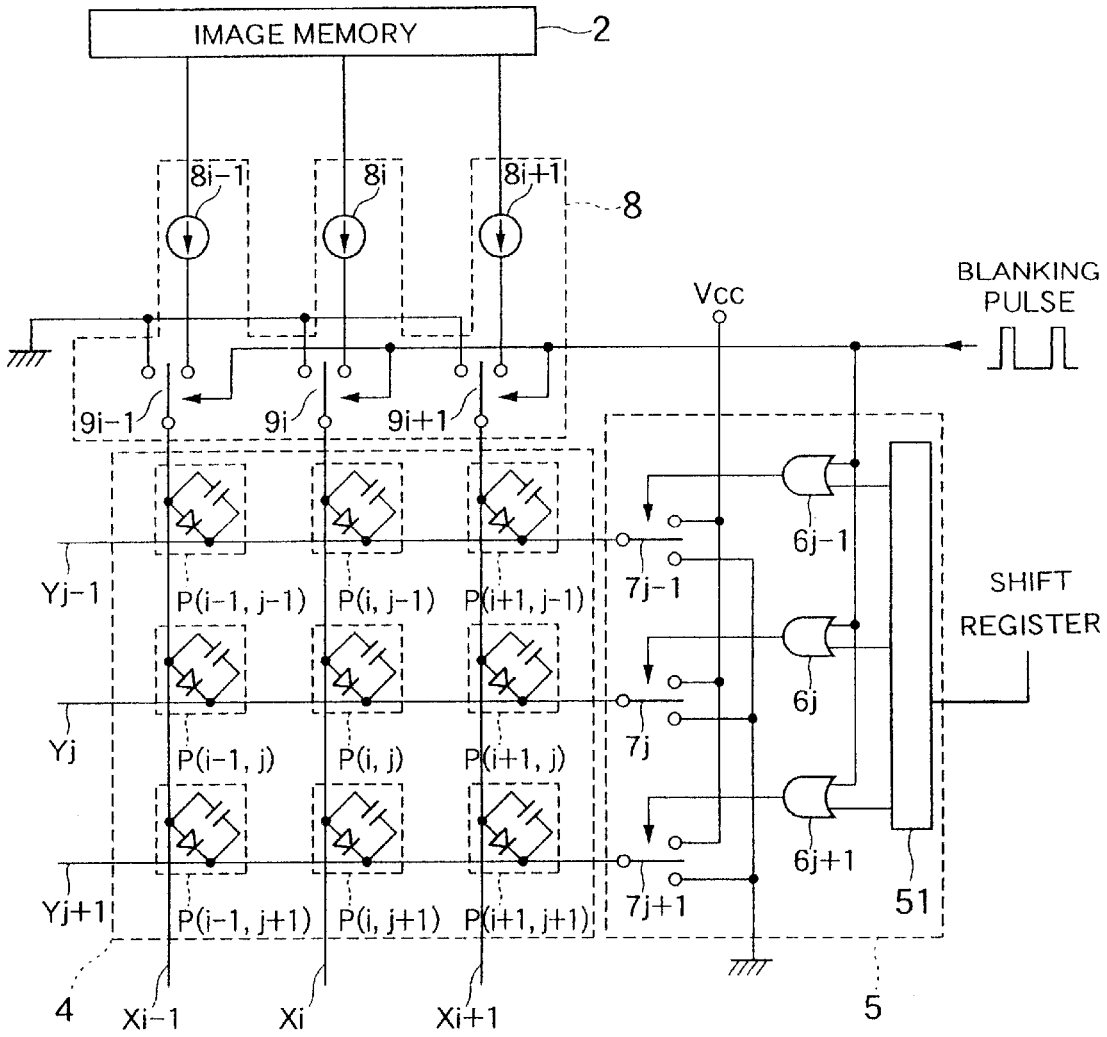
FIG. 1 (PRIOR ART)
FIG. 1 is a circuit diagram of the prior art.
Figure 2:
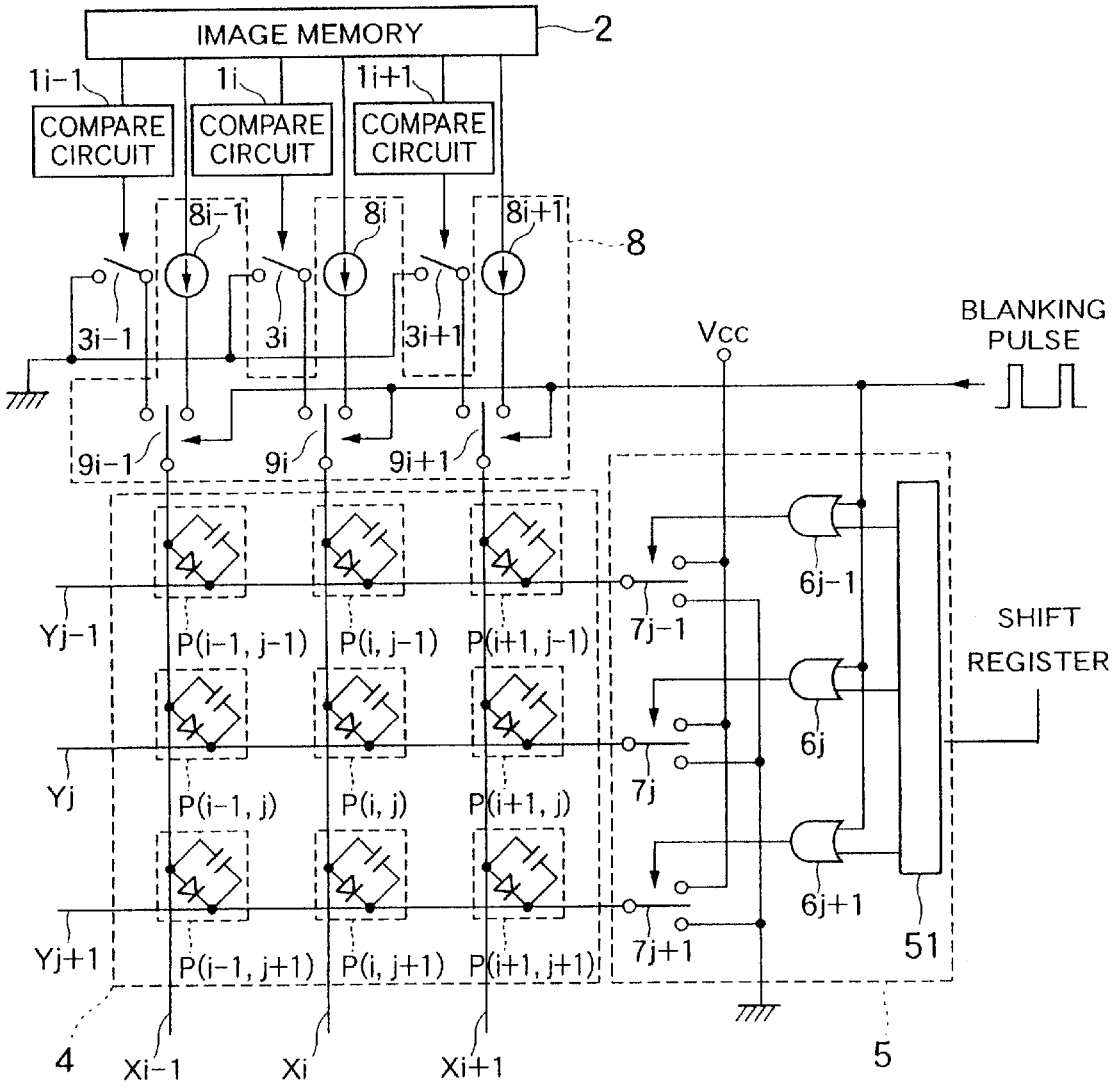
FIG. 2 is a circuit diagram showing a driving device of an organic thin film EL display according to a first embodiment of the present invention.

As shown in FIG. 2, a compare circuit 1*i* provided for a data electrode Xi (i=1 to m: m is the number of data electrodes) reads the image signal voltage S(i, j) (J=1 to n: n is the number of the scanning electrodes) for the current display period and the image signal voltage S(i, j+1) for the next display period from an image memory 2 to compare them. During a blanking period immediately before the next display period, the discharge circuit 3*i* controls the quantity of residual electric charge discharged from the data electrode Xi depending on this comparison result. That is, the data electrode Xi is controlled depending on the comparison result so that residual electric charges are discharged or not.

Figure 3:
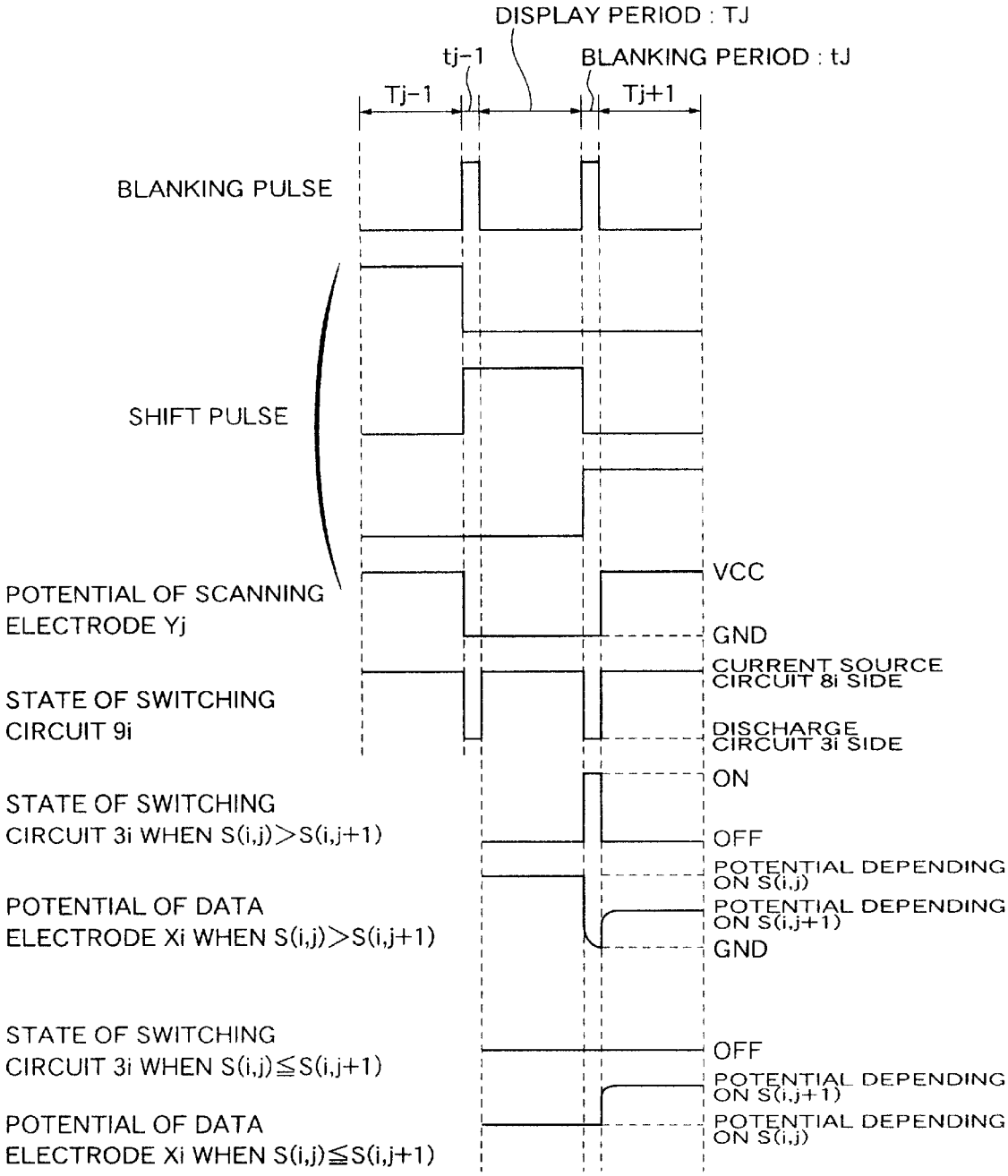
FIG. 3 is a timing chart illustrating a specific operation of the first embodiment of the present invention.
Figure 4:
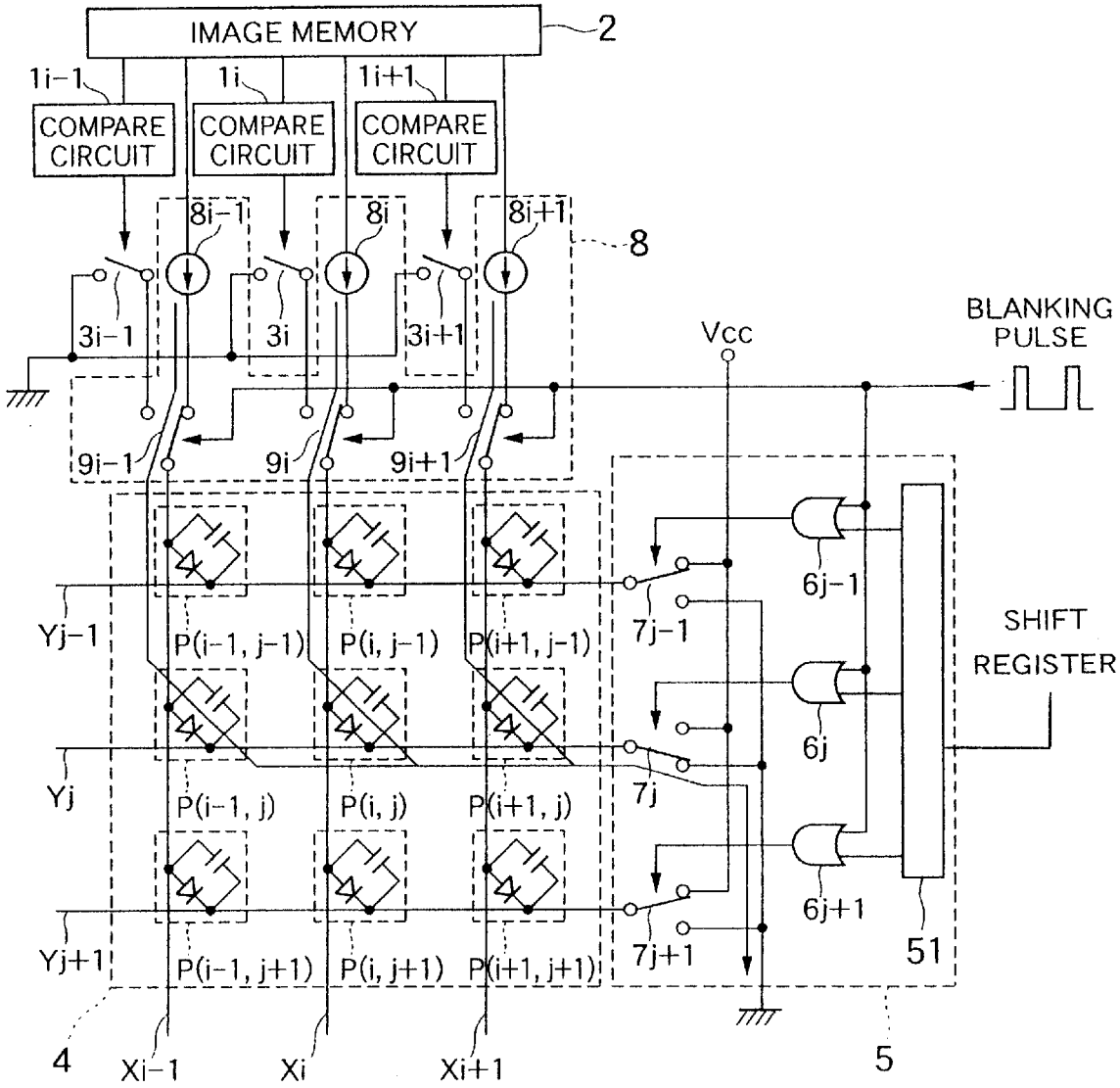
FIG. 4 is a circuit diagram illustrating a current flow and a state that electric charges are accumulated during a display period Tj in the first embodiment of the present invention.
Figure 5:
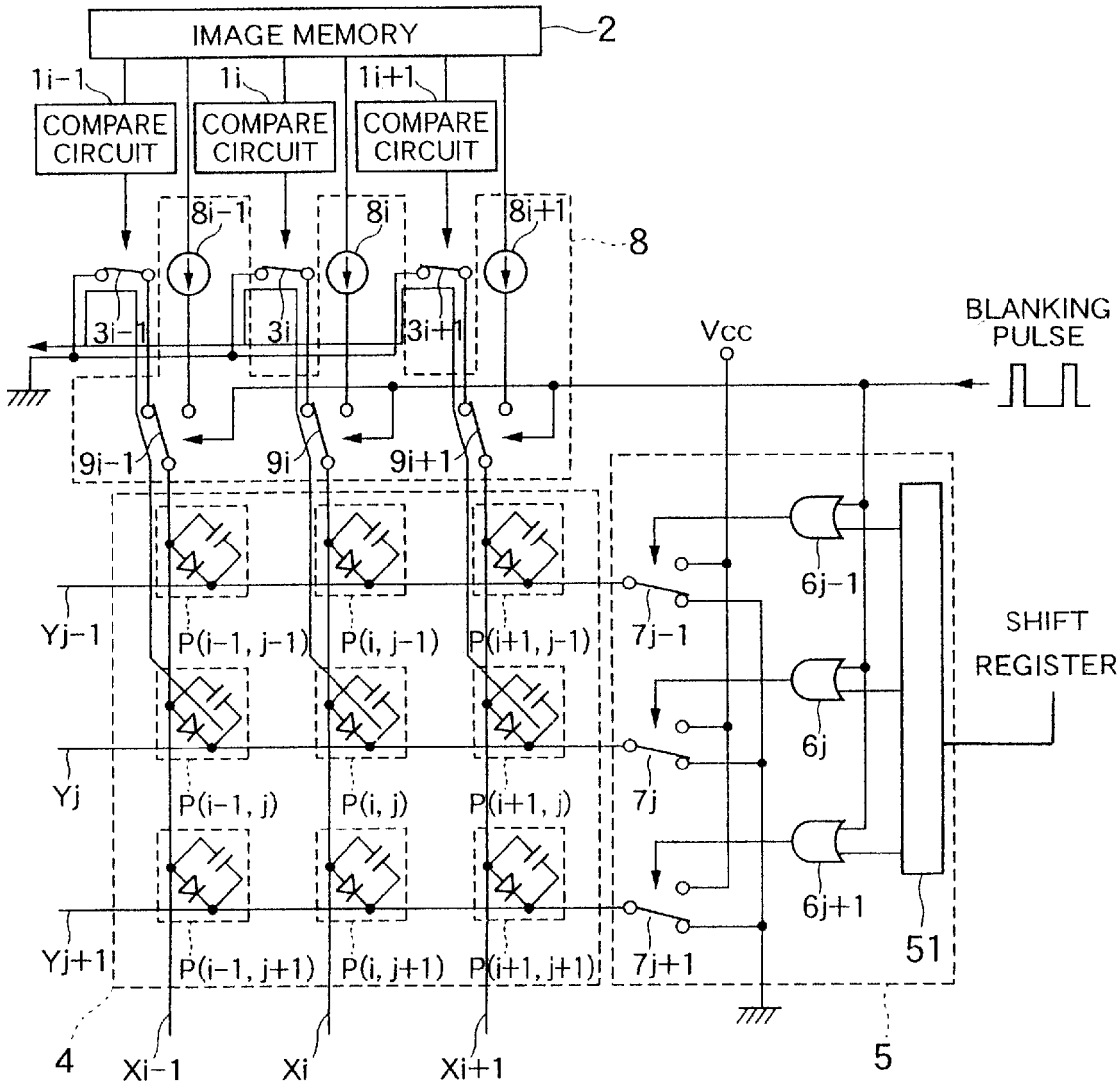
FIG. 5 is a circuit diagram illustrating a state that electric charges are discharged during a blanking period tj when S(i, j)>S(i, J+1)
Figure 6:
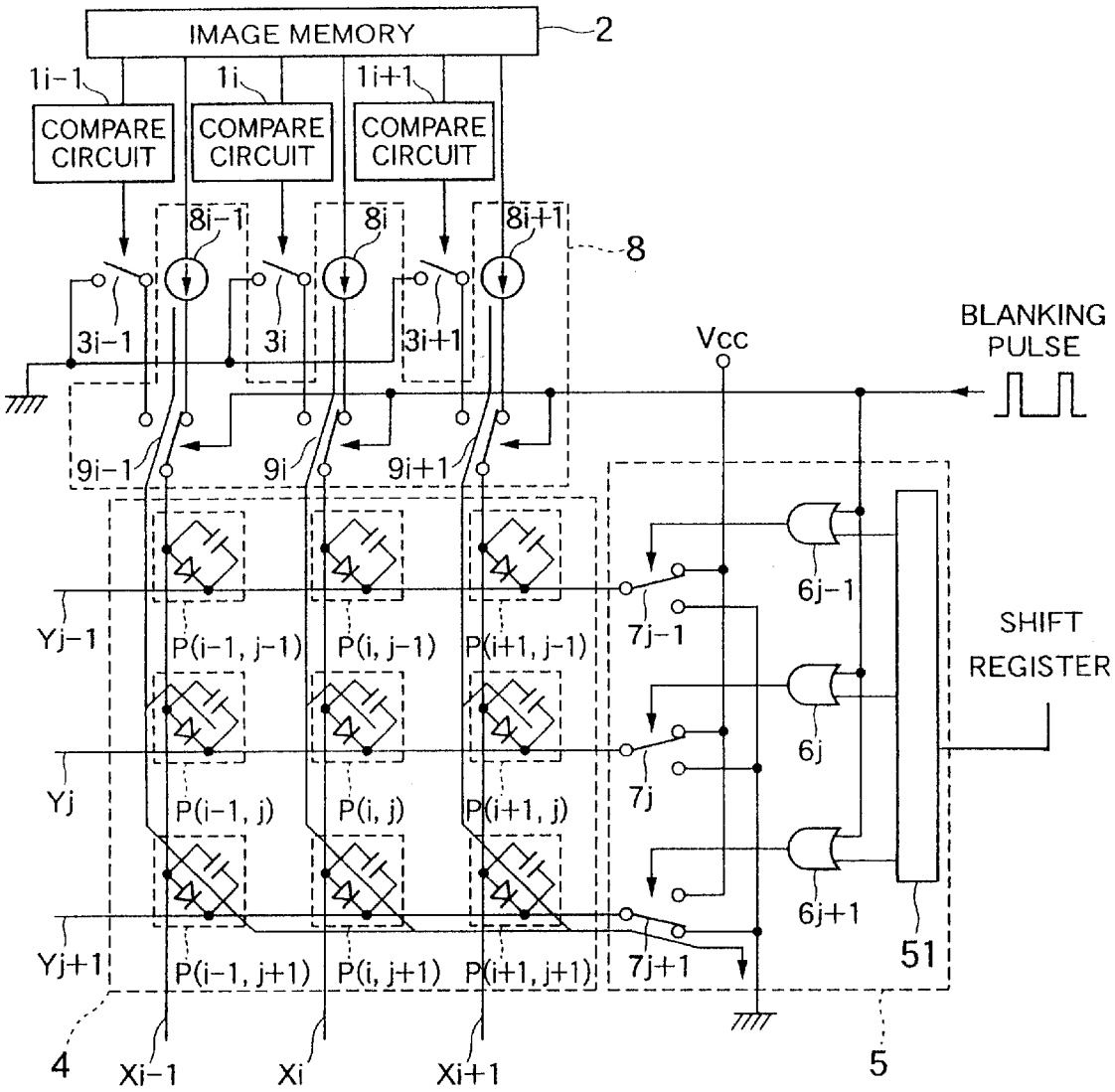
FIG. 6 is a circuit diagram illustrating a current flow and a state that electric charges are transferred during a display period T(j+1) when S(i, j)≦S(i, j+1)

FIGS. 2 to 6 show the driving device of organic thin film EL display according to the first embodiment of the present invention. FIG. 3 is a timing chart of the first embodiment illustrating an operation of the first embodiment of the present invention. FIG. 4 is a circuit diagram illustrating a current flow and a state that electric charges are accumulated during a display period Tj in the first embodiment of the present invention. FIG. 5 is a circuit diagram illustrating a state that electric charges are discharged during a blanking period tj when S(i, j)>S(, j+1). FIG. 6 is a circuit diagram illustrating a current flow and a state that electric charges are transferred during a display period T(j+1) when S(i, j)≦S(i, j+1).

These figures show a driving device of an organic thin film EL display constituted such that display elements P(i, j) composed of organic thin film EL light-emitting elements are connected to respective intersections of data electrodes Xi (i=1 to m) and scanning electrodes Yj (J=1 to n) arrayed in a matrix. While a scanning electrode is scanned at predetermined periods, the display element emits light in response to a signal applied to the data electrode in synchronization with the scanning.

The driving device has comparator 1*i* for comparing the signal voltage S(i, j) applied to a display element P(i, j) on a predetermined data electrode Xi on a scanning electrode Yj for the current display period and the signal voltage S(i, j+1) applied to the display element P(i, j+1) on this data electrode Xi and on the scanning electrode Y(J+1) for the next display period.

The driving apparatus also has controller 3*i* for controlling a quantity of residual electric charges discharged from the data electrode on the currently displaying scanning electrode Yj during a blanking period immediately before the next display period depending on the comparison result by the comparator.

In a first case (S(i, j)>S(i, j+1)), the controller 3*i* controls the data electrode Xi on the currently displaying scanning electrode Yj so that residual electric charges are discharged during the blanking period immediately before the next display period. In a second case (S(i, j)≦S(, j+1) ), the controller 3*i* controls the data electrode Xi so that the residual electric charges are not discharged.

The controller 3*i* controls a discharge circuit which holds the data electrode in the ground level.

An image memory 2 having a memory capacity at least enough for 2×m (m: the member of a data electrodes) is also provided. The signal voltage S(l, j) to S(m, j) applied to each data electrode X1 to Xm on scanning electrode Yj for the current display period and the signal voltage S(1, j+1) to S(m, j+1) applied to each data electrode X1 to Xm on the scanning electrode Y(J+1) for the next display period are stored in this image memory 2 so that the comparator 11 to 1*m* can compare the data in the image memory 2.

The driving apparatus for driving an organic thin film EL display is also characterized by having the same number of discharge circuits as the number of data electrodes (m).

Figure 8:
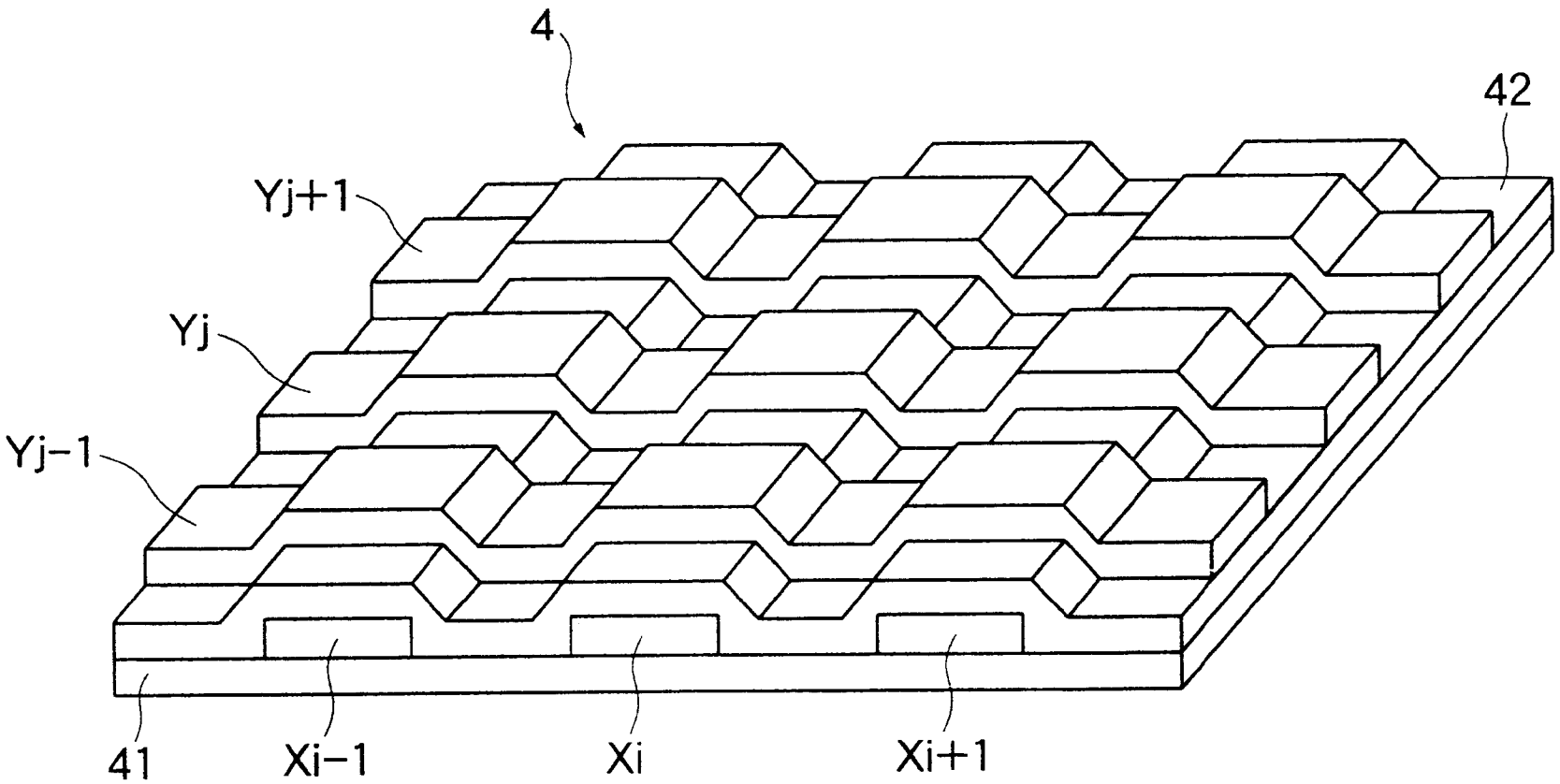
FIG. 8 is a perspective view showing a structure of an organic thin film EL display.

The first embodiment will be described in further detail below. FIG. 8 is a perspective view showing a structure of an organic thin film EL display.

FIG. 8 shows a common structure of an organic thin film EL display 4 driven by the present invention. In FIG. 8, an organic thin film EL display 4 is composed of a number (m) of data electrodes Xi (i=1–m) and a number (n) of scanning electrodes Yj(J=1=n) formed orthogonally to each other on a substrate 41 and an organic thin film layer 42 interposed between these electrodes. As a substrate 41, light-transmittable glass, resin or the like is used. As a data electrode Xi, light-transmittable ITO, NESA film, metal thin film or the like is used. As a scanning electrode Yj, Ag/Mg alloy, Al/Li alloy or the like is used. The organic thin film layer 42 is constituted by a plurality of organic laminated layer film composed of a hole implantation layer, hole transport layer, light-emitting layer, electron transport layer, electron implantation layer and so forth or a single layer film composed of only a light-emitting layer and is formed by a thin film forming technique such as a vacuum deposition method, spin-coating method, casting method or the like. In the above-described structure, when the data electrode Xi is charged as anode and the scanning electrode Yj is charged as cathode, the organic light-emitting layer of the region interposed between the data electrode Xi and the scanning electrode Yj emits light as a pixel P (i, j). In FIG. 2, a pixel P (i, j) is represented by a diode symbol and a capacitor connected in parallel with the diode. An image memory 2 is a memory circuit having a memory capacity at least enough for 2x m (m: the number of pixels) and can be achieved by afield memory, FIFO, DRAM, SRAM or the like. A scan circuit 5 is composed of a shift register 51, an OR circuit 6*j* and a switching circuit 7*j*. A driving circuit 8 is constituted by a current source circuit 8*i* for supplying current to the data electrode Xi depending on the image signal voltage S(i, j) and a switching circuit 9*i*. A compare circuit 1*i* compares the image signal voltage S(i, j) for the current display period and the image signal voltage S(i, j+1) for the next display period read form the image memory 2 and controls the discharge circuit 3*i* during a blanking period. The simplest form of a discharge circuit 3*i* is a switching circuit.

The operation of the first embodiment will be described below.

FIG. 3 is a timing chart showing an operation of each part of FIG. 2.

When a start pulse is applied to a shift register 51, a shift is made in synchronization with a clock pulse. A switching circuit 7*j* is controlled by a shift pulse and a blanking pulse so that the scanning electrode Yj is connected to the ground side when the control input is at a high level and connected to the power supply voltage VCC side when the control input is at a low level. On the other hand, the switching circuit 9*i* is controlled only by a blanking pulse so that the data electrode Xi is connected to the discharge circuit 3*i* when the control input is at a high level and connected to the current source circuit 8*i* when the control input is at a low level. Therefore, during a display period Tj, current is supplied from the current source circuit 8*i* to the data electrode Xi depending on the image signal voltage S (i, j). As shown in FIG. 4, is S(i, j)>0, the charge current flows in the order of the current source circuit 8*i*, the switching circuit 9*i*, the pixel P (i, j), the switching circuit 7*j* and the ground (GND). Then, the pixel P(i, j) emits light and electric charges are accumulated in the parallel capacitor. During this period, the image signal voltage S(i, j) for the current display period and the image signal voltage S(i, j+1) for the next display period are compared in the compare circuit 1*i*.

During a blanking period tj, all the scanning electrode Yj have a ground potential by a blanking pulse applied to the OR circuit 6*j*. At this time, the data electrode Xi is connected to the discharge circuit 3*i* side, but the discharge circuit 3*i* is controlled by the compare circuit 1*i* as follows depending on the comparison result of the displayed image signal voltage S(i, j) and the image signal voltage S(i, j+1) for the next scanning period.

As shown in FIG. 5, if S(i, j)>S(i, j+1) , the discharge circuit 3*i* composed of switching circuits is turned on and electric charges accumulated in the pixel P (i, j) are discharged. At this time, the discharge path is constituted in the order of the parallel capacitor of the pixel P (i, j), the switching circuit 9*i*, the discharge circuit 3*i*, the ground, the switching circuit 7*j* and the parallel capacitor of the pixel P (i, j).

On the contrary, as shown in FIG. 6, if S(i, j)≦S(i, J+1), the discharge circuit 3*i* is turned off, electric charges accumulated in the pixel P(i, j) are not discharged and the parallel capacitor of the pixel P(i, j+1) is charged during the next display period T(j+1). At this time, the charge path is constituted in the order of the power supply (VCC), the switching circuit 7*j*, the parallel capacitor of the pixel P(i, j), the parallel capacitor of the pixel P(i,j+1), the switching circuit 7(j+1) and the ground.

Figure 7:
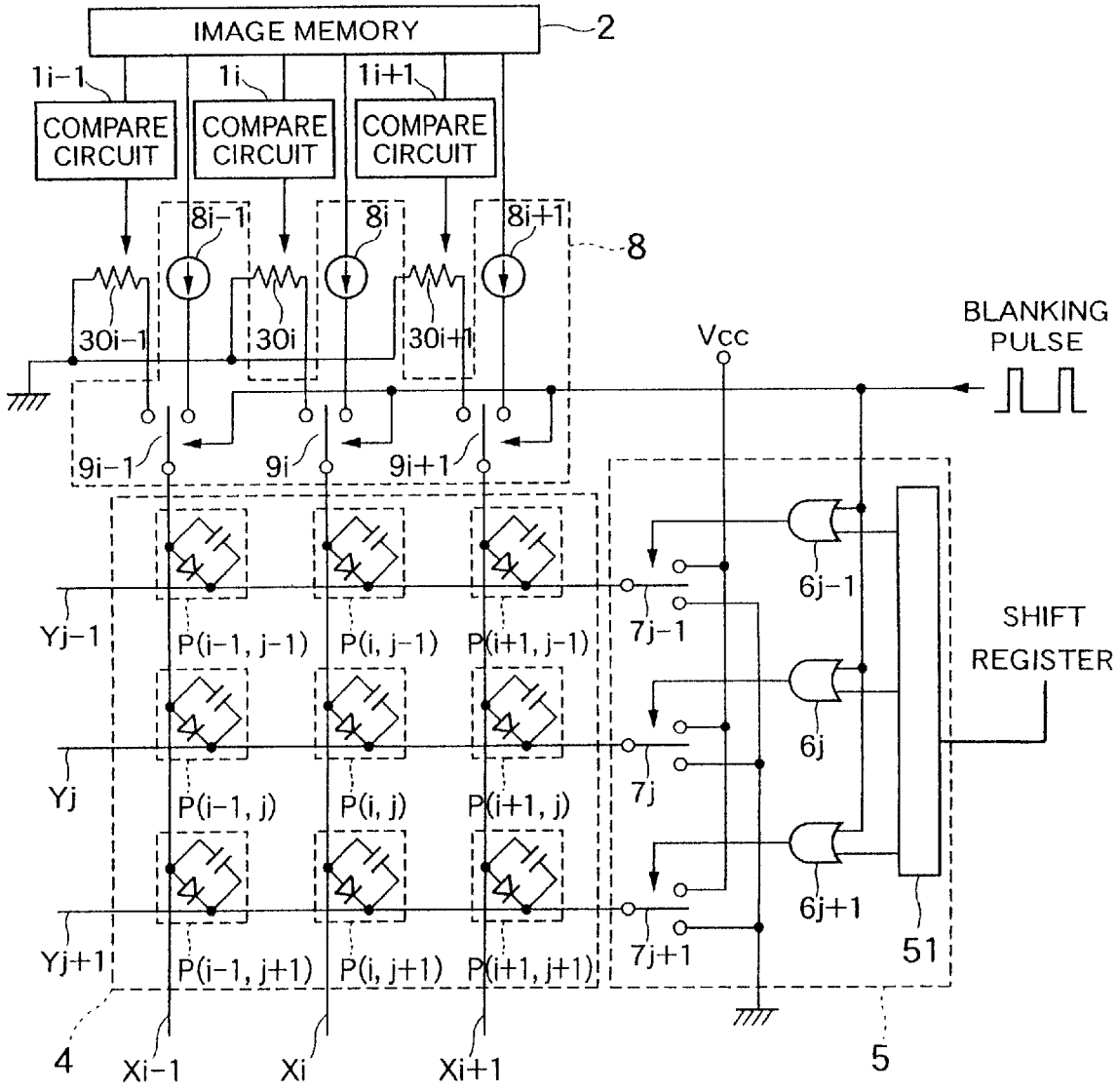
FIG. 7 is a circuit diagram showing a driving device of an organic thin film EL display according to a second embodiment of the present invention.

FIG. 7 is a circuit diagram showing a driving device and a driving method of an organic thin film EL display according to a second embodiment of the present invention.

FIG. 7 shows a driving device of an organic thin film EL display constituted such that display elements P(i, j) composed or organic thin film EL light-emitting elements are connected to respective intersections of data electrodes Xi and scanning electrodes Yj arranged in a matrix. While a scanning electrode is scanned at predetermined periods, the display element emits light in response to a signal applied to the data electrode in synchronization with the scanning.

The driving device has a comparator 1*i* (i=1 to m) for comparing the signal voltage S(i, j) applied to the display element P(i, j) on a predetermined data electrode on the scanning electrode Yj for the current display period and the signal voltage S(i, j) applied to the display element on this data electrode and on the scanning electrode for the next display period.

The driving device also has a controller (discharge circuit 30*i*) for controlling a quantity of residual electric charges discharged from the data electrode on the currently displaying scanning electrode to a predetermined value during a blanking period immediately before the next display period depending on the comparison result by the comparator.

The second embodiment will be described in further detail below. The discharge circuit 30*i* has a resistance and the comparator circuit 1*i* controls the resistance value of the discharge circuit 30*i*.

In reference to FIG. 7, the discharge circuit 30*i* is a current control circuit. Also, the compare circuit 1*i* is constituted by an arithmetic circuit to calculate D(i, j)=S(i, j)−S(i, j+1) during the display period Tj. Then, if D(i, j)≦0, the current volume flow through the discharge circuit 30*i* during the blanking period tj is restricted as maximum and residual electric charges are not discharged from the data electrode Xi. If D(i, j)>0, the current volume flow through the discharge circuit 30*i* during the blanking period tj is changed depending on the value of D(i, j). That is, the smaller the D(i, j) value is, the larger the current volume discharged through the discharged circuit 30*i* is restricted. By controlling as above, even if S(i, j)>S(i, j+1), electric charges are not discharged wastefully from the data electrode during the blanking period. Thus, the electric power saving effect is further enhanced.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A driving device of an organic thin film EL display which comprises display elements composed of organic thin film EL light-emitting elements connected to respective intersections of data electrodes and scanning electrodes arrayed in a matrix, wherein while the scanning electrode is scanned at predetermined periods, the display element emits light in response to a signal applied to the data electrode in synchronization with this scanning; said driving device comprising;

a comparator configured to compare a signal voltage applied to the display element on a predetermined data electrode and on the scanning electrode for the current display period and a signal voltage applied to the display element on this data electrode and on the scanning electrode for the next display period; and a controller coupled to said comparator and configured to selectively control a discharge of residual electric charges from the data electrode and on the currently displaying scanning electrode during a blanking period immediately before the next display period depending on the comparison result by the comparator.

2. The driving device of an organic thin film EL display according to claim 1, wherein the controller controls the data electrode of the currently displaying scanning electrode so that residual electric charges are discharged during the blanking period immediately before the next display period, if an image signal voltage S(i, j) for the current discharge period is larger than an image signal voltage S(i, j+1) for the next display period; and the data electrode is controlled so that residual electric charges are not discharged, if an image signal voltage S(i, j) for the current discharge period is equal to or less than an image signal voltage S(i, j+1) for the next display period.

3. The driving device of an organic thin film EL display according to claim 1, wherein said controller controls a discharge circuit which holds said data electrode to the ground level.

4. The driving device of an organic thin film EL display according to claim 3, wherein a number of said discharge circuits is same as the number of the data electrodes (m).

5. The driving device of an organic thin film EL display according to claim 1, comprising an image memory having a memory capacity of at least enough for 2×m (m: the number of data electrodes) is provided; wherein the signal voltage applied to each of the data electrodes on the currently displaying scanning electrode for a display period is stored in said image memory;

the signal voltage applied to each of the data electrodes on the scanning electrode for the next display period is stored; and the comparator compares the data in the image memory.

6. The driving device of an organic thin film EL display according to claim 5, wherein a number of said discharge circuits is same as the number of the data electrodes (m).

7. A driving device of an organic thin film EL display which comprises display elements composed of organic thin film EL light-emitting elements connected to respective intersections of data electrodes and scanning electrodes arrayed in a matrix; wherein while the scanning electrode is scanned at predetermined periods, the display element emits light in response to a signal applied to the data electrode in synchronization with this scanning; said driving device comprising;

a comparator configured to compare a signal voltage applied to the display element on a predetermined data electrode and on the scanning electrode for the current display period and a signal voltage applied to the display element on this data electrode and on the scanning electrode for the next display period; and a controller coupled to said comparator and configured to selectively control a quantity of residual electric charges discharged from the data electrode and on the currently displaying scanning electrode during a blanking period immediately before the next display period depending on the comparison result by the comparator.

8. The driving device of an organic thin film EL display according to claim 7, wherein the controller controls the data electrode of the currently displaying scanning electrode so that residual electric charges are discharged during the blanking period immediately before the next display period, if an image signal voltage S(i, j) for the current discharge period is larger than an image signal voltage S(i, j+1) for the next display period; and the data electrode is controlled so that residual electric charges are not discharged, if an image signal voltage S(i, j) for the current discharge period is equal to or less than an image signal voltage S(i, j+1) for the next display period.

9. The driving device of an organic thin film EL display according to claim 7, wherein said controller controls a discharge circuit which holds said data electrode to the ground level.

10. The driving device of an organic thin film EL display according to claim 9, wherein a number of said discharge circuits is same as the number of the data electrodes (m).

11. The driving device of an organic thin film EL display according to claim 7, comprising an image memory having a memory capacity of at least enough for 2×m (: the number of data electrodes) is provided; wherein the signal voltage applied to each of the data electrodes on the currently displaying scanning electrode for a display period is stored in said image memory;

the signal voltage applied to each of the data electrodes on the scanning electrode for the next display period is stored; and the comparator compares the data in the image memory.

12. The driving device of an organic thin film EL display according to claim 11, wherein a number of said discharge circuits is same as the number of the data electrodes (m).

13. A method for driving an organic thin film EL display comprising display elements composed of organic thin film EL light-emitting elements and connected to respective intersections of data electrodes and scanning electrodes disposed in a matrix; and a scanning electrode scanned at predetermined periods, while said display element emits light in response to a signal applied to the data electrode in synchronization with this scanning; said method comprising the steps:

comparing a signal voltage applied to the display element on a predetermined data electrode and on the scanning electrode for the current display period and a signal voltage applied to the display element on the data electrode and on the scanning electrode for the next display period; and controlling the data electrode so as to be in the discharge state during a blanking period immediately before the display period when the signal voltage applied to the display element on the predetermined data electrode and on the scanning electrode for the current display period is larger than the signal voltage applied to the display element on the data electrode for the next display period or controlling the data electrode so as not to be in the discharge state otherwise.

* * * * *

UNITED STATES PATENT AND TRADEMARK OFFICE

CERTIFICATE OF CORRECTION

PATENT NO. : 6,369,516 B1
DATED : April 9, 2002
INVENTOR(S) : Iketsu et al.

It is certified that error appears in the above-identified patent and that said Letters Patent is hereby corrected as shown below:

Column 8,
Line 29, change ";" (semicolon) to -- , -- (comma).

Column 9,
Line 2, change "(:" to -- (m: --.

Signed and Sealed this

Twenty-ninth Day of October, 2002

*Attest:*

*Attesting Officer*

JAMES E. ROGAN
*Director of the United States Patent and Trademark Office*